US005505217A

United States Patent [19]

Takagi et al.

[11] Patent Number: 5,505,217

[45] Date of Patent: Apr. 9, 1996

[54] APPARATUS FOR WASHING AND DRYING DISCRETE PARTS

[75] Inventors: Masami Takagi, Mie; Yukihisa Kenpe, Tsu; Hisashi Tsuge, Mie; Yasuo Miyake, Tsu, all of Japan

[73] Assignee: Matsushita Electric Works, Ltd., Osaka, Japan

[21] Appl. No.: 439,952

[22] Filed: May 12, 1995

Related U.S. Application Data

[62] Division of Ser. No. 260,314, Jun. 15, 1994.

[30] Foreign Application Priority Data

| | | | |
|---|---|---|---|
| Jun. 21, 1993 | [JP] | Japan | 5-149448 |
| Aug. 27, 1993 | [JP] | Japan | 5-213147 |
| Aug. 27, 1993 | [JP] | Japan | 5-213148 |
| Apr. 25, 1994 | [JP] | Japan | 6-086812 |

[51] Int. Cl.[6] ..... B08B 3/10

[52] U.S. Cl. ..... 134/63; 134/66; 134/117; 134/132

[58] Field of Search ..... 134/132, 61, 63, 134/117, 66, 69; 451/326, 327

[56] References Cited

U.S. PATENT DOCUMENTS

| | | | |
|---|---|---|---|
| 2,746,468 | 5/1956 | Desmond et al. | 134/132 X |
| 2,980,121 | 4/1961 | Schuricht et al. | 134/132 X |
| 3,777,770 | 12/1973 | Cunningham-Smith | 134/132 X |
| 4,063,564 | 12/1977 | Francis | 134/132 X |
| 4,305,210 | 12/1981 | Christensen et al. . | |
| 5,117,850 | 6/1992 | Money | 134/132 X |

*Primary Examiner*—Philip R. Coe
*Attorney, Agent, or Firm*—Stevens, Davis, Miller & Mosher

[57] ABSTRACT

A cleaning and drying apparatus comprises a vessel having a closed bottom and a side wall extending upwardly from the circumference of the bottom. The vessel has an inlet for introducing the discrete parts on the bottom of the vessel and an outlet formed in an upper end of the side wall for removing the parts out of the vessel. A spiral track is formed on the interior surface of the side wall to ascend therealong in a spiral manner about a vertical center axis of the vessel from the bottom to the outlet. A liquid line is connected to supply a cleaning liquid into the vessel. An level controller is provided to keep a level of the cleaning liquid in the vessel well below the outlet in such a manner as to divide the length of the spiral track into a drying zone immersed in the cleaning liquid and a drying zone disposed above the level. A vibrator is connected to apply vertical and circumferential vibrations which produces a driving force to feed the discrete parts upwardly along the spiral track to the outlet through the cleaning zone and continuously through the drying zone during which the discrete parts are washed by the cleaning liquid while being fed through the cleaning zone. A dryer is adapted to direct a forced hot air flow along the drying zone to remove the cleaning liquid from the surfaces of the parts.

5 Claims, 16 Drawing Sheets

APPARATUS FOR WASHING AND DRYING DISCRETE PARTS

This is a Divisional of application Ser. No. 08,260,314 filed Jun. 15, 1994.

BACKGROUND OF THE INVENTION

1. Field of the Invention

The present invention is directed to an apparatus for washing and drying discrete parts, and more particularly to such apparatus for cleaning dirt, grease and like other contaminants from the surface of the discrete parts.

2. Description of the Prior An

A prior washing and drying apparatus is known to utilize a basket storing a number of individual parts to be cleaned. The basket is introduced into a tank containing a volume of a cleaning liquid to submerse the parts therein for washing contaminants off the parts with application of vibrations to the parts. Then, the basket is removed from of the tank for drying the parts, by the use of a centrifugal dryer or other drying equipment. Thus, the prior apparatus relies upon batch processes which interrupts a continuous manufacturing line of feeding the parts to an assembly station.

SUMMARY OF THE INVENTION

In view of the above problem, the present invention has been made to provide a superior parts cleaning and drying system which replaces the individual batch process and enables continuous parts cleaning and drying readily incorporated into a manufacture line of feeding the parts to an assembly station. The cleaning and drying apparatus in accordance with the present invention comprises a vessel having a closed bottom and a side wall extending upwardly from the circumference of the bottom. The vessel has an inlet for introducing the discrete parts on the bottom of the vessel and an outlet formed in an upper end of the side wall for removing the parts from the vessel. A spiral track is formed on the interior surface of the side wall to ascend therealong in a spiral manner about a vertical center axis of the vessel fromthe bottom to the outlet. A liquid line is connected to supply a cleaning liquid into the vessel. An level controller is provided to keep a level of the cleaning liquid in the vessel well below the outlet in such a manner as to divide the length of the spiral track into a drying zone immersed in the cleaning liquid and a drying zone disposed above the level. A vibrator is connected to apply vertical and circumferential vibrations which produces a driving force for feeding the discrete parts upwardly along the spiral track to the outlet through the cleaning zone and continuously through the drying zone, during which the discrete parts are washed by the cleaning liquid while being fed through the cleaning zone. A dryer is adapted to direct a forced hot air flow along the drying zone to remove the cleaning liquid from the surfaces of the parts. In this manner, the parts are fed continuously along the spiral track to the outlet during which parts cleaning and drying are made successively done. In particular, with the use of the vibrations for driving the parts along the spiral track, the individual parts can proceed along the track with less chance of contacting to each other. Thus, the parts in the drying zone can have its entire surface exposed to the forced air flow for successfully drying without leaving a stain which would otherwise occur on the surface of the parts overlapped with each other.

Accordingly, it is a primary object of the present invention to provide an apparatus for washing and drying discrete parts which is capable of presenting a continuous process of cleaning and drying the discrete parts so that it is readily incorporated into a manufacturing line leading from a parts supplying station to a parts assemble station, yet assuring effective and successful drying of the parts.

The level controller comprises an overflow tube connected to the vessel for overflowing the cleaning liquid out of the vessel together with a scum of contaminants removed from the parts.

The spiral track further includes a dripping zone for dropping the cleaning liquids off the parts. The dripping zone is disposed above the level of the cleaning liquid in the vessel and leads to the drying zone. The spiral track of the dripping zone comprises a perforated bed on which the parts are fed towards the drying zone so that a large portion of the cleaning liquid remaining on the surface of the parts can be dropped prior to the parts being fed to the drying zone for expediting the drying with a smaller energy requirement, which is therefore another object of the present invention.

The liquid supply line preferably includes a nozzle which is disposed in the vessel to spray the cleaning liquid over the parts being fed from the cleaning zone to the dripping zone for washing off any contaminants held on the parts for effective parts cleaning, which is therefore a still further object of the present invention.

Preferably, the liquid supply line is connected to the overflow tube through a purifier which removes contaminants from the overflowing cleaning liquid enable reuse of the cleaning liquid.

In preferred embodiments, the spiral track in the dripping zone is configured to have a bed plate with a plurality of risers which divides the length of the bed plate into a plurality of stepped sections having an inclined bottom extending upwardly along the direction of feeding the parts. A shower is disposed at the upper end of the length of the dripping zone to spray the cleaning liquid over the parts being fed on the bed plates. The cleaning liquid is then directed downwardly along the bed plate in a direction opposite to the feeding direction of the parts, increasing chances of contacting the parts with the liquids for enhanced cleaning of the parts. While flowing along the bed plate, the liquid is temporarily stored in the lower portion in each stepped section followed by overflowing beyond the riser into the lower adjacent stepped section. The remaining upper portion of the stepped section, which is defined above the upper end of the downwardly adjacent riser, acts to guide the liquid overflowing from the upwardly adjacent stepped section to the lower portion and holds no substantial cleaning liquid thereon. With this result, the parts are fed along successively through the stepped sections so as repeatedly to be dipped in the liquid stored in the lower portion and dripped off the liquid on the upper portion, thereby further improving cleaning efficiency.

Alternately, the spiral track in the dripping zone may be configured to have a perforated bed plate with a plurality of risers which divide the length of the bed plate into a plurality of like stepped sections having an inclined bottom extending upwardly along the direction of feeding the parts. The riser is formed with a port through which the cleaning liquid passes. A gutter extends in juxtaposition below the bed plate and communicates through perforations in the bed plate as well as through the ports in the risers into the stepped sections in order to collect and deliver the cleaning liquid from and to the stepped sections and flow the cleaning liquid along the gutter in an opposite direction of feeding the parts. The inclined bottom of the stepped section extends upwardly along the feeding direction of the parts up to a level which is higher than the port in the riser positioned immediately downstream of the stepped section with respect to the flowing direction of the cleaning liquid, whereby the stepped section is divided into a pool region which stores the cleaning liquid for dipping the parts therein and a drip region which is located above the level of the cleaning liquid in the pool region to drip the cleaning liquid off the parts. The perforated bed plate ensures effective liquid dripping off parts being fed on the drip region, while the liquid can be smoothly guided into the downstream stepped section through the ports in the riser as well as through the perforations in the bed plates for successively dipping the parts in the liquid in the pool regions.

Another preferred embodiment of the present invention utilizes a cleaning vessel and a separate drying vessel. The cleaning vessel has a closed bottom and a side wall extending upwardly from the circumference of the bottom, and is provided with an inlet for introducing the discrete parts on the bottom and with a transfer outlet for removing the parts out of me vessel. The transfer outlet is formed in an upper end of the side wall. Formed on the interior of the side wall of the cleaning vessel is a spiral cleaning track which extends upwardly in a spiral manner about a vertical axis of the vessel from the bottom to the transfer outlet. A liquid supply line is connected to supply a cleaning liquid into the cleaning vessel. A first vibrator is connected to apply vertical and circumferential vibrations which give a driving force for feeding the discrete parts upwardly along the spiral cleaning track to the transfer outlet during which the parts are washed with the cleaning liquid. The drying vessel, which has a closed bottom and a side wall extending upwardly from the circumference of the bottom, is provided with a transfer inlet for introducing the parts into the drying vessel and a release port for discharging the parts out of the drying vessel. Also formed on the interior side surface of the drying vessel is a spiral drying track which extends upwardly in a spiral manner about a vertical axis of the vessel from the bottom to the release port. A chute bridges across the transfer outlet to the transfer inlet for delivering that parts from the cleaning vessel to the bottom of the drying vessel. A second vibrator is connected to apply vertical and circumferential vibrations which give a driving force for feeding the discrete parts upwardly along the drying track to the release port. The drying vessel is provided with a dryer which directs a forced hot air flow along the spiral drying track to remove the cleaning liquid from the discrete parts being fed along the drying track. Also in this embodiment, the parts are fed continuously through the cleaning spiral track, the chute and through the drying spiral track for effecting continuous processing, yet enabling one to elongate the length of the tracks for enhanced cleaning and drying of the parts.

Preferably, a single vibrator is utilized for simultaneously applying the vibrations to the cleaning and drying vessels. To this end, the drying vessel is disposed below in a vertically aligned relation with the cleaning vessel and they are mechanically interconnected to each other to be commonly coupled to the single vibrator.

The drying vessel may be a double-wall structure with an inner chamber and an outer chamber concentric to the inner chamber. The inner chamber is formed with the transfer inlet through which the parts are delivered from the cleaning vessel into a bottom of the inner chamber. The inner chamber has on its interior surface a spiral dripping track extending upwards from the bottom in a spiral manner about a vertical axis of the vessel to a transit port which is formed in the upper end of the inner chamber and communicated to the outer chamber for delivering the parts to a bottom of the outer chamber. The spiral dripping track is perforated so as to remove the cleaning liquid remaining on the parts being fed along the dripping track towards the transit port. Then, the parts are fed along the spiral drying track formed along the interior surface from the bottom to the release port. With this double-wall structure, the drying vessel can afford additional dripping track in addition to the drying spiral track for improving drying efficiency.

Further, additional spiral track can be formed on the exterior surface of the inner chamber to feed the parts downwardly from the transit port to the bottom of the outer chamber by the vibrations applied to the drying vessel for giving a more elongated feed distance and therefore improved drying capability. The drying track may be in the form of a duct for concentrating the forced air flow on the parts being fed along the drying track and/or have a perforated bottom for removing residual liquid therethrough.

The cleaning vessel may be likewise designed into a double wall structure with an inner chamber and an outer chamber divided by a partition. The inner and outer chambers are provided on the inner and outer surfaces of the partition respectively with first and second spiral tracks for feeding the parts therealong in contact with the cleaning liquids over an extended travel distance. The inner and outer chamber are filled with the cleaning liquid which is supplied into the outer chamber and portion of which is delivered to the inner chamber through a transfer port provided for transferring the parts from the inner chamber to the outer chamber. An overflow line is connected to the inner chamber at a portion above the transfer port so as to overflow the cleaning liquid from the inner chamber for keeping the cleaning liquid in both of the inner and outer chambers at a level above the transfer port. A third spiral track is formed on the inner surface of the cleaning vessel opposed to the second spiral track to ascend from the bottom of the outer chamber to an outlet in the upper end of the vessel. The third spiral extends above the level of the cleaning liquid in the outer chamber to define along the length thereof a cleaning zone and a drying zone respectively below and above the level of the cleaning liquid such that the parts being fed along the cleaning zone are washed by the cleaning liquid in the outer chamber and that the parts being fed along the drying zone are removed of the cleaning liquid. With this double-wall structure, the cleaning vessel can afford an extended travel distance for feeding the parts and therefore improve cleaning effect.

The cleaning vessel has an air nozzle which is disposed on the upper end of the third spiral track to give a forced air flow being fed through the drying zone. The vessel may additionally include a steam nozzle disposed above the connection of the overflow line to the inner chamber to discharge a steam over the parts being fed along a lower portion of the drying zone to wash off the residual cleaning liquid from the parts just emerging out of the cleaning liquid.

The cleaning vessel can be further combined with a water tank disposed below the cleaning vessel for effecting additional washing of the parts with water. The water tank has a transfer inlet for introducing the parts into the tank bottom and release port for removing the parts from the tank. A chute extends downwardly from the outlet of the vessel to the transfer inlet for transferring the parts by gravity into the tank. The tank is supplied with water from a water supply line and is connected to a water overflow line at a portion below the release port so as to overflow the water from the water tank for keeping the water level below the release port. A fourth spiral track is formed on the interior surface of the tank wall to ascend therealong from the bottom of the tank to the release port. The cleaning vessel and the water tank are interconnected by a rod and commonly coupled to a vibrator which produces a driving force for feeding the discrete parts upwardly along the fourth spiral track. The fourth spiral track extends beyond the water level in the water tank to define along the length thereof a water washing zone and a drying zone respectively below and above the water level. Whereby, the parts being fed along the water washing zone are washed by the water in the tank and the parts being fed along the drying zone are removed of the water by exposure to tho forced air flow from an air nozzle disposed on the upper end of the drying zone. With the addition of the water tank, the parts once processed by a suitable cleaning medium can be washed with water while being fed over an extended spiral path, yet sharing the same vibrator for feeding the parts in the water tank. The cleaning medium is preferably an aqueous solution of a substance, for example, N-methyl-2-pryrrolidone capable of separating a grease from the surface of the parts without substantially emulsifying the separated grease.

These and still other objects and advantageous features will become more apparent from the following description of the embodiments when taken in conjunction with the attached drawings.

DETAILED DESCRIPTION OF THE PREFERRED EMBODIMENTS

First Embodiment <FIGS. 1 to 4>

Figure 1:
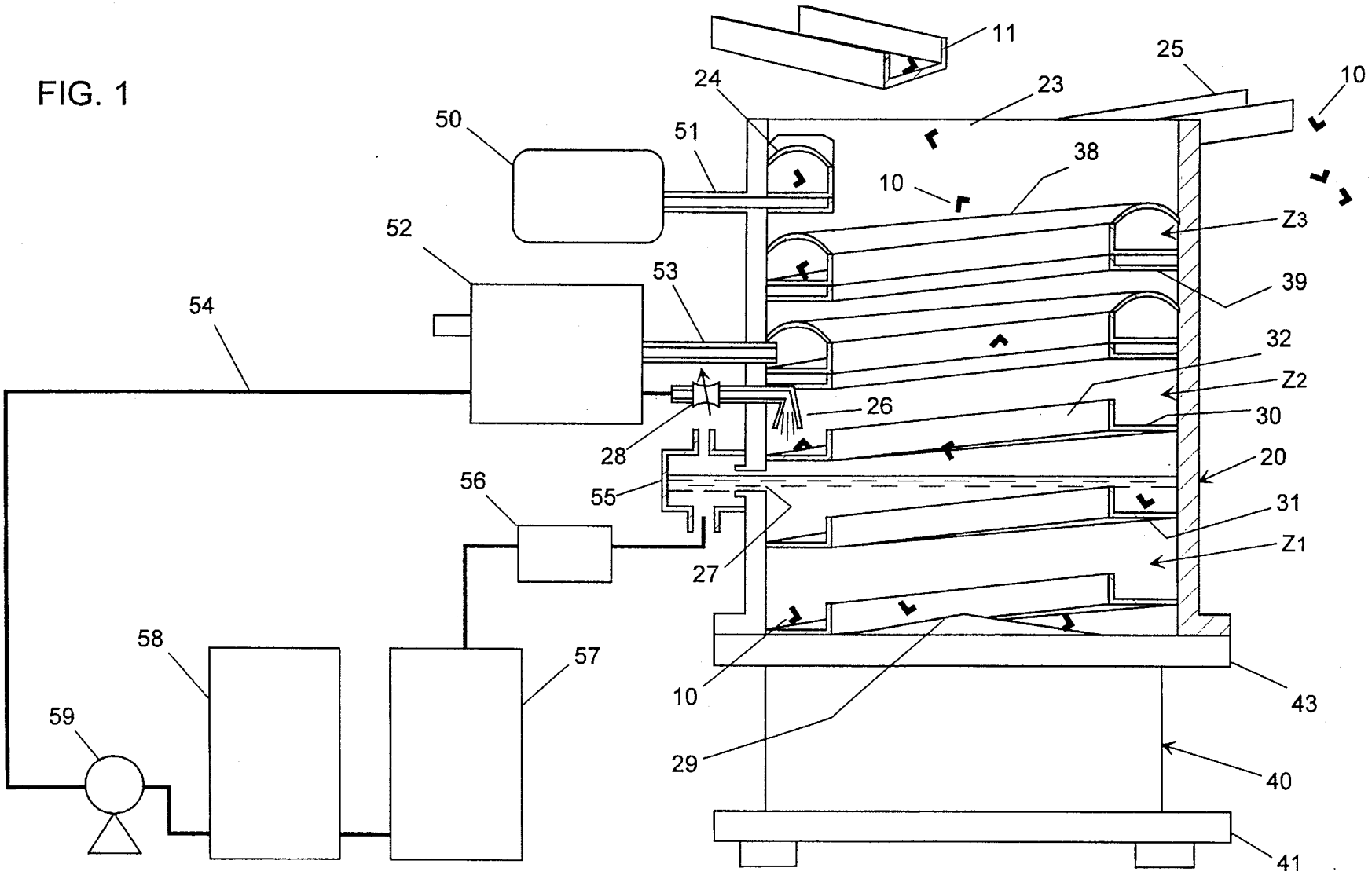
FIG. 1 is a front view, partially in vertical section, of an apparatus for cleaning and drying discrete parts in accordance with a first embodiment of the present invention.
Figure 2:
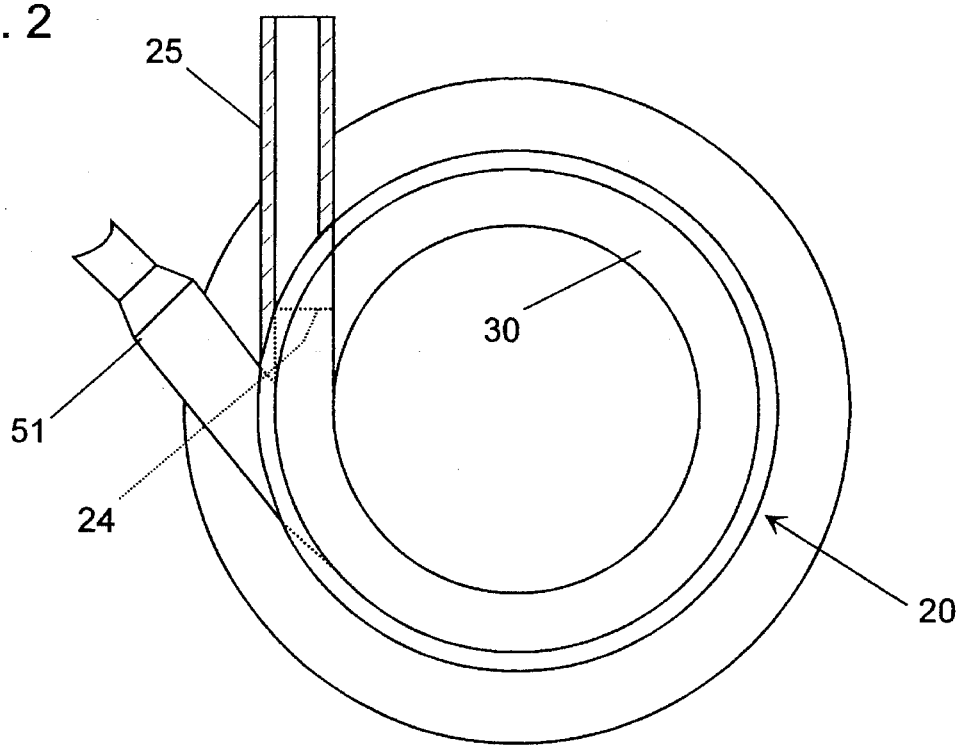
FIG. 2 is a plan view of the apparatus.

Referring now to FIG. 1, there is shown a parts washing and drying apparatus in accordance with a first embodiment of the present invention, The parts processed by the apparatus include those made of stainless steel, rust-proof coated iron or other metals, and plastic material which are press-formed, roll-formed forged, or molded into various shapes. The apparatus utilizes a cleaning liquid for removing dirt, grease, and other contaminants adhering on the parts. When the parts carrying grease are processed the cleaning liquid is preferably an aqueous solution of a substance for example. N-methyl-2-pryrrolidone capable of separating a grease from the surface of the pars without substantially emulsifying the separated grease. Such cleaning liquid is commercially available from Mitsubishi Kasei Ltd., Japan as a product name "Kasei Cleaner", from Otsuka Kagaku Kabushiki Kaisha. Japan, as "Shadan C&S-1000", from Okuno Seiyaku Ltd. Japan as "Ace Clean". The cleaning liquid is not limited to the above and can be selected from a variety of cleaning mediums depending upon the contaminants intended to be removed.

The apparatus comprises a top-opened cylindrical vessel 20 with a bottom 21 and a side wall 22. The vessel 20 defines at its top-opening an inlet 23 for introducing discrete parts 10 therein. The parts 10 are continuously supplied through a conveyer 11 disposed above the vessel 20 and are caused to drop by gravity on the bottom 21 of the vessel 20 through the inlet 23. An outlet 24 is formed in the upper end of the side wall 22 to discharge the parts 10 out of the vessel 20 by way of a discharge chute 25 extending outwardly from the outlet 24. The vessel 20 includes a nozzle 26 disposed at a middle height of the vessel to supply a cleaning liquid into the vessel 20. An overflow port 27 is formed in the side wall 22 below the nozzle 26 to overflow the liquid out of the vessel 20 for keeping a constant liquid level in the vessel 20. Formed on the interior of the side wall is a spiral track 30 which extends from the bottom to the outlet 24 in a spiral manner about a vertical center axis of the vessel 20 for feeding the parts upwardly therealong by the effect of specific vibrations applied to the vessel 20. Such vibrations are produce by a vibrator 40 and transmitted to the vessel mounted on the vibrator 40.

Figure 3:
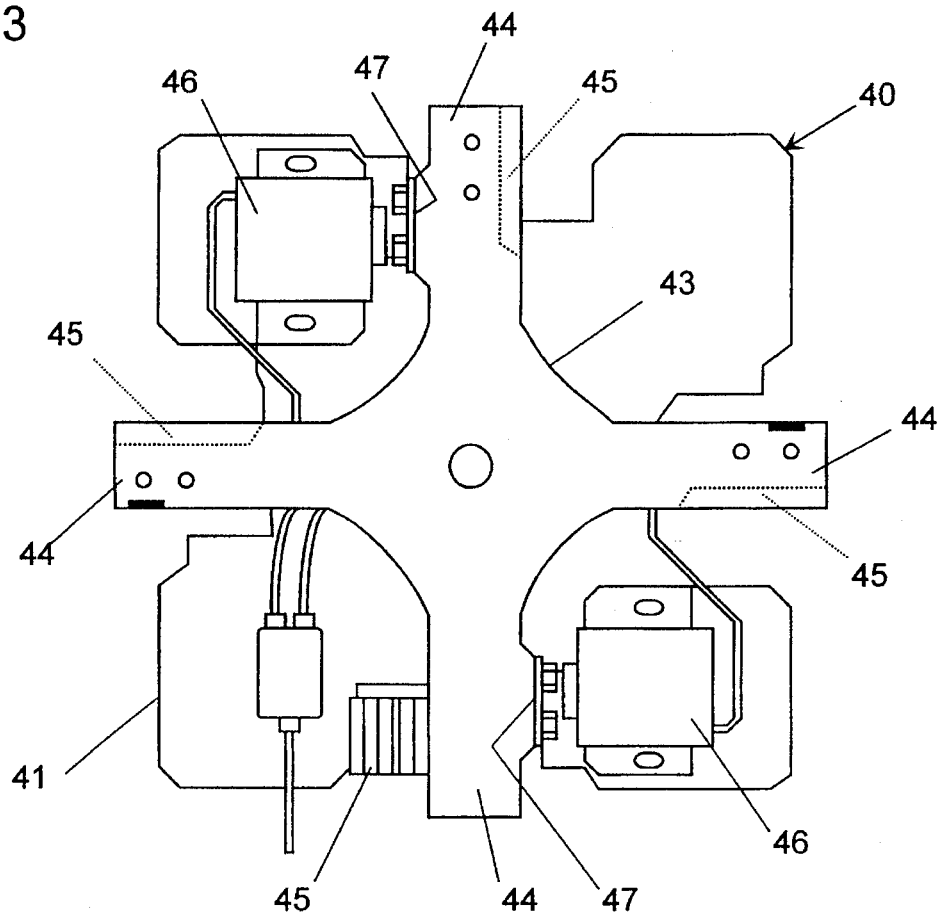
FIGS. 3 and 4 are plan and front views respectively of a vibrator utilized in the apparatus.
Figure 4:
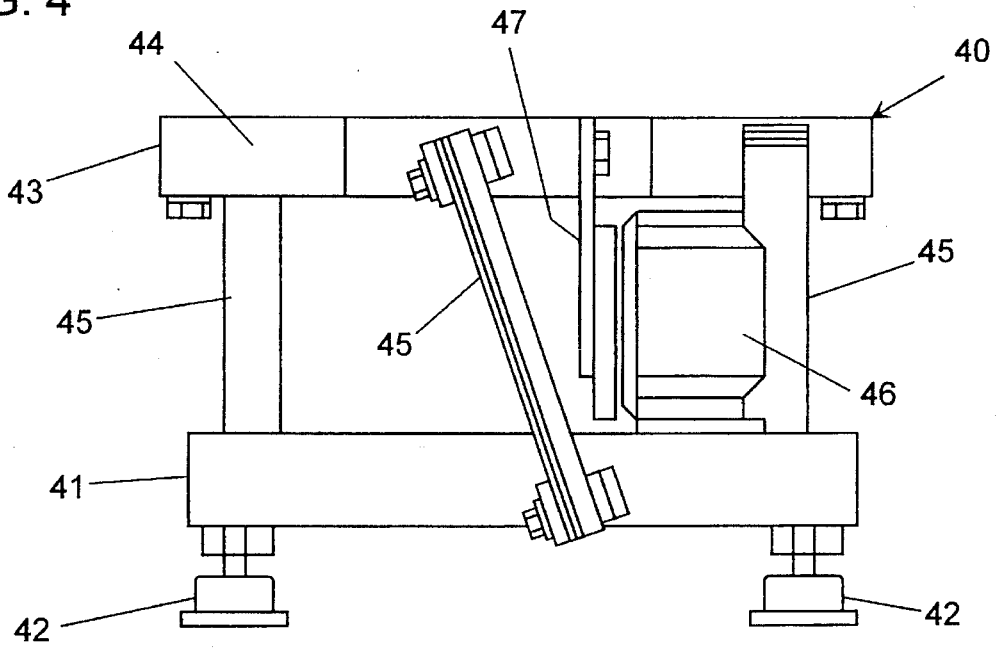

As shown in FIGS. 3 and 4, the vibrator 40 comprises a fixed lower base 41 with shock-absorbing feet 42 and a movable upper base 43 mounting thereon the vessel 20. The upper base 43 is cross-shaped to have four arms 44 which are coupled to the lower base 41 respectively by leaf springs 45. The leaf springs 45 are inclined with respect to vertical such that the upper base 43 is movable relative to the lower base 41 in a circumferentially direction with an attendant vertical movement within a limited extent by resiliently deforming the springs 45. The lower base 41 carries a pair of diagonally opposed solenoids 40 which are disposed in closely adjacent relation to armature plates 47 depending from the corresponding arms 44 of the upper base 43. Upon energization the solenoids 46 attract the armature plates 47 to thereby turn the upper base 43 about the vertical axis in a counter-clockwise direction in FIG. 3 relative to the lower base 41. This movement involves raising the springs 45 towards upright positions to thereby lift the upper base 43 relative to the lower base 41. Upon deenerization of the solenoids 46, the springs 45 urge the upper base 43 to return immediately into original neutral position as shown in the figures. Thus, the vibrator 40 produces circumferential and vertical vibrations by intermittently energizing the solenoids at a suitable frequency. The vibrations applied to the vessel 20 give a driving force for moving the parts 10 on the bottom of the vessel 20 along the inner circumference of the side wall 22 to the lower end of the spiral track 30 and feeding the parts 10 along the spiral track 30 upwardly to the outlet 24 against gravity. That is, the parts are caused to toss up off the spiral track 30 in a forward stroke of the vibrations applied to the vessel 20 immediately followed by a return stroke which occurs before the parts 10 fall back on the spiral track 30. Thus, the parts tossed up from one point on the spiral track 30 fall on an upwardly adjacent point on the spiral track 30 so that the parts are fed step-by-step upwardly along the spiral track 30. The spiral track 30 comprises a bed plate 31 and an upright fence 32 extending along the inner periphery of the bed plate 31. A conical-shaped member 29 is formed on the bottom of the vessel 20 for guiding the parts towards the lower end of the spiral track 30.

As seen in FIG. 1, the spiral track 30 extends upward beyond the liquid level to define a cleaning zone $Z_1$ in which the parts 10 are washed with the cleaning liquid as being fed along the spiral track, and a dripping zone $Z_2$ just above the liquid level and a drying zone $Z_3$ above the dripping zone $Z_2$. The parts emerged out of the cleaning liquid is fed through the dripping zone $Z_2$ where residual liquid on the surface of the parts are dropped off and is subsequently fed into the drying zone $Z_3$ wherein it is exposed to a forced air flow to be dried. The spiral track 30 is preferably perforated particularly in the dripping zone $Z_2$ and in the drying zone $Z_3$. The nozzle 26 is disposed adjacent the lower end of the dripping zone $Z_2$ to spray the cleaning liquid 10 over the parts just emerging from the cleaning liquid for washing off the contaminants adhering on the parts, The drying zone $Z_3$ comprises a duct formed along the spiral track 30 to direct the forced air flow generated at a dryer or blower 50. The duct comprises a top cover 38 and an under cover 39 fitted on and under the spiral track 30. The dryer 50 is coupled at the upper end of the spiral adjacent the outlet 24 to introduce the force hot air flow through a tube 51 into a space confined between the spiral track 30 and the under cover 39. The bed plate 31 of the spiral track 30 in the drying zone $Z_3$ is perforated so that the hot air can spread in a space between the spiral track 30 and the top cover 38 with a buffering effect of not substantially exposing the parts 10 to the intense flow of the hot air flowing in the direction opposite to the feeding direction of the pain. Extending from the lower end of the duct is an exhaust pipe 53 for discharging the hot air flow through an heat exchanger 51 disposed outside of the vessel 20. Also extending through the exchanger 51 is a liquid supply line 54 leading to the nozzle 26 so that the exchanger 51 transfers the heat from the duct to the cleaning liquid immediately upstream of the nozzle 26. Thus, the residual heat of the drying zone $Z_3$ is best utilized to heat the cleaning liquid for improved cleaning efficiency.

The liquid supply line 54 is in the form of a closed recirculation loop including the vessel 20 and extending from the overflow port 27, a surge tank 55, a filter 56, a purifier tank 57, an ion exchanger tank 58, and a pump 59 to the nozzle 26, with a regulation valve 28. The surge tank 55 receives the cleaning liquid overflowing through the overflow port 27 together with a scum of the contaminant separated from the surfaces of the parts 10 which are subsequently delivered to the filter 56 where an insoluble components of the contaminants are removed. The resulting liquid is then fed through the purifier tank 57 with a reverse osmosis membrane and the ion exchanger tank 58 with a suitable ion exchanger so as to have soluble components removed. Thus cleaned liquid is pressurized by the pump 59 and is heated through the heat exchanger 58 so as to be sprayed into the vessel 20. A fresh cleaning liquid may be supplemented to the liquid supply line as necessary.

Second Embodiment <FIGS. 5 to 11>

Figure 5:
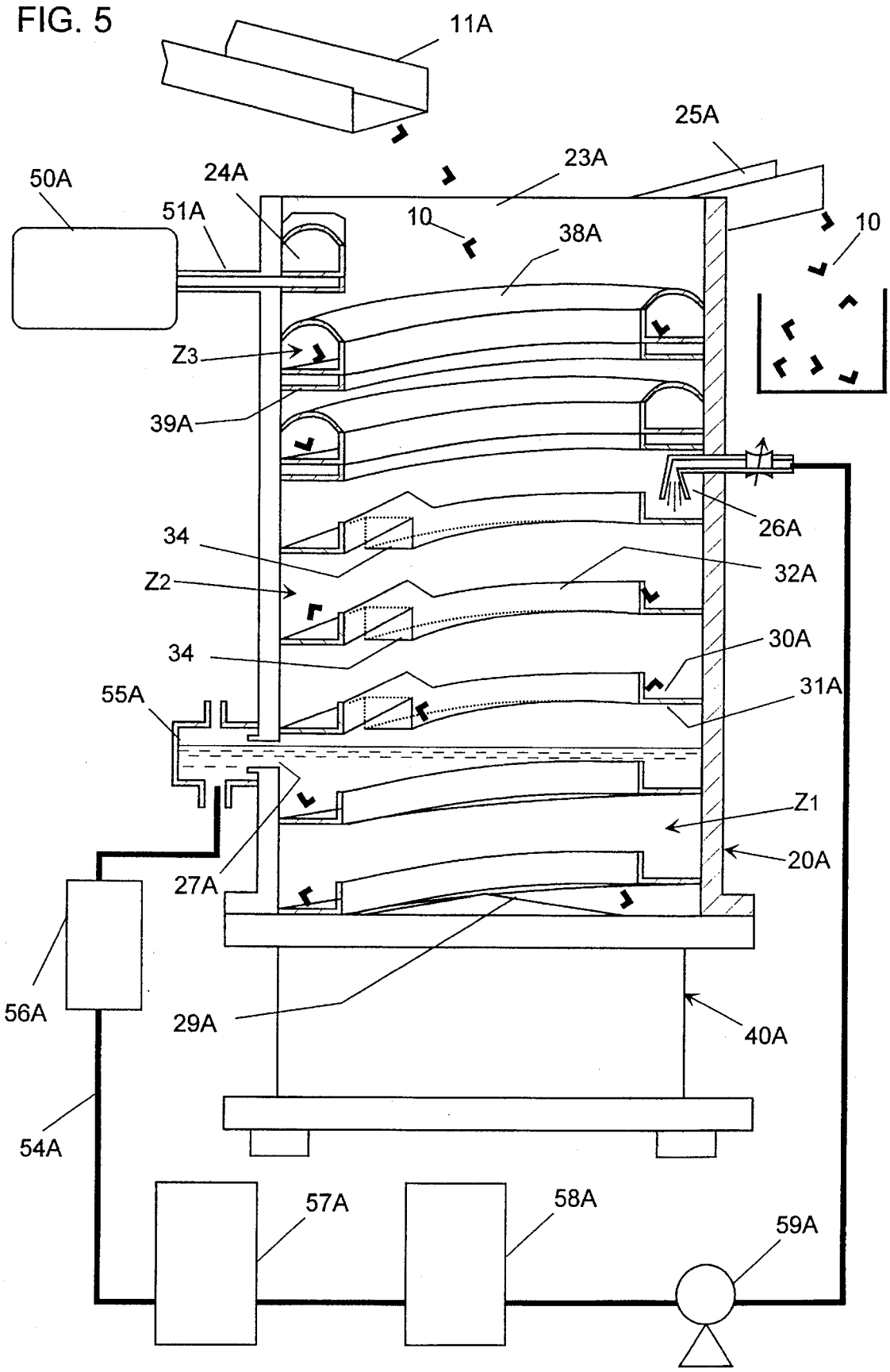
FIG. 5 is a front view, partially in vertical section, of a like apparatus in accordance with a second embodiment of the present invention.
Figure 6:
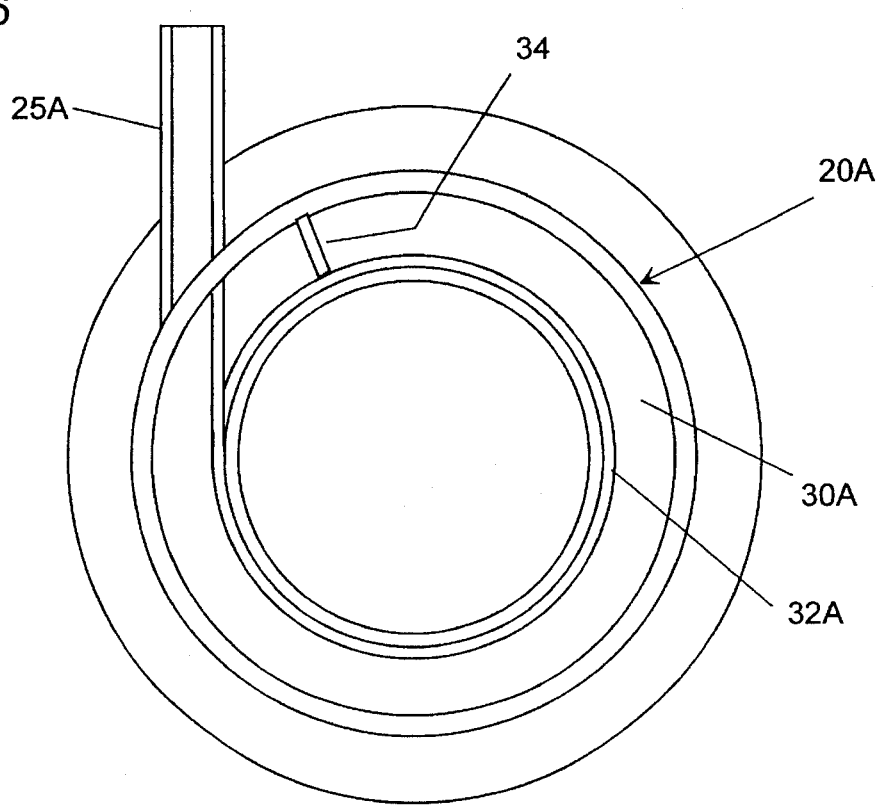
FIG. 6 is a plan view of the apparatus of FIG. 5.
Figure 7:
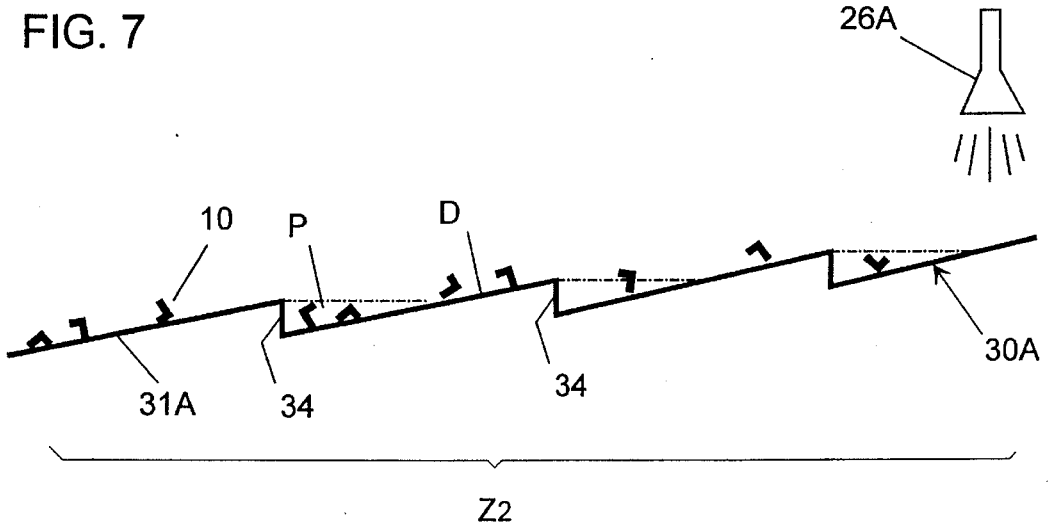
FIG. 7 is a schematic diagram illustrating a specific portion of a spiral track formed in the apparatus of FIG. 5.
Figure 8:
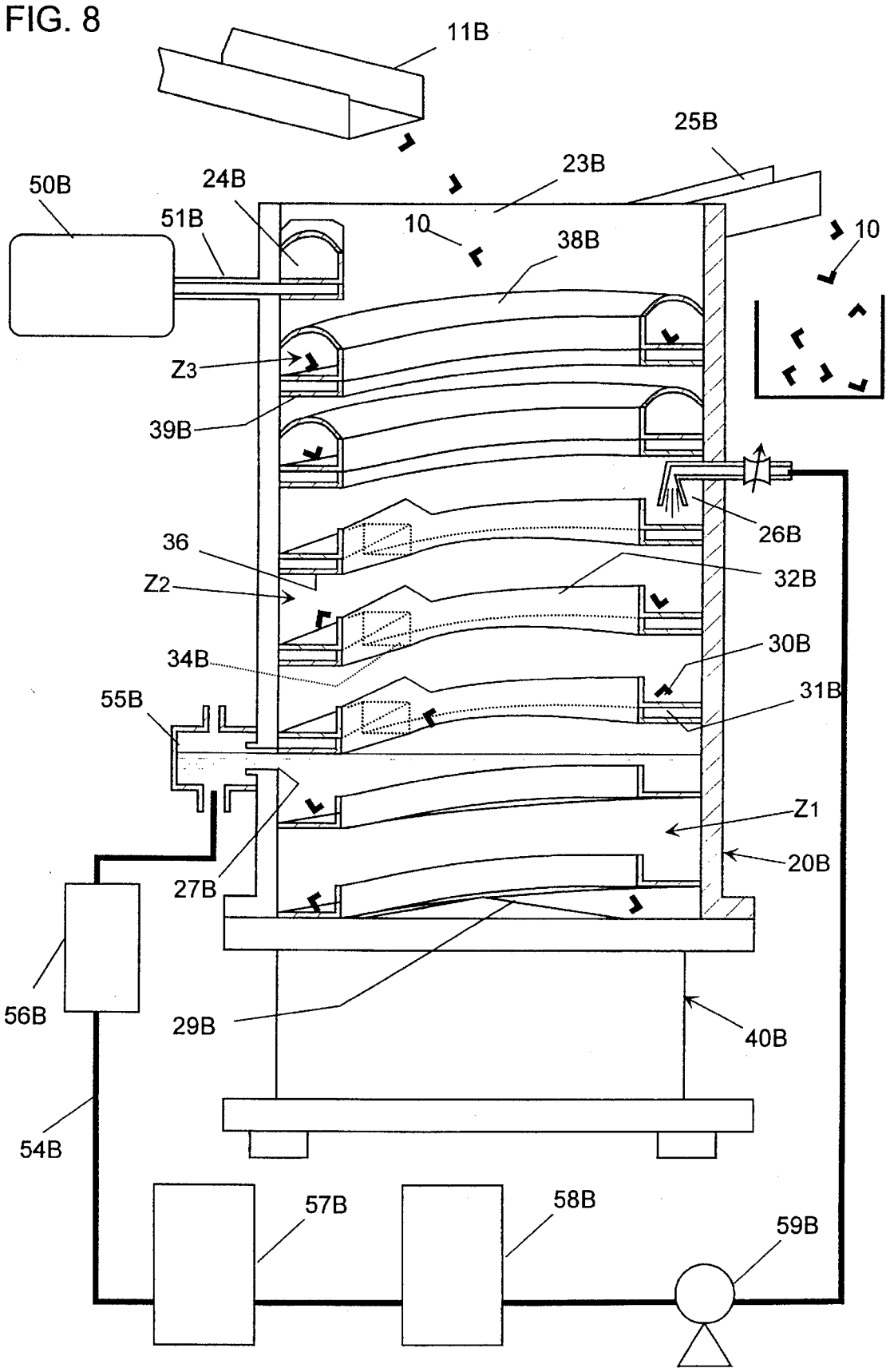
FIG. 8 is a front view of a modification of the second embodiment.
Figure 9:
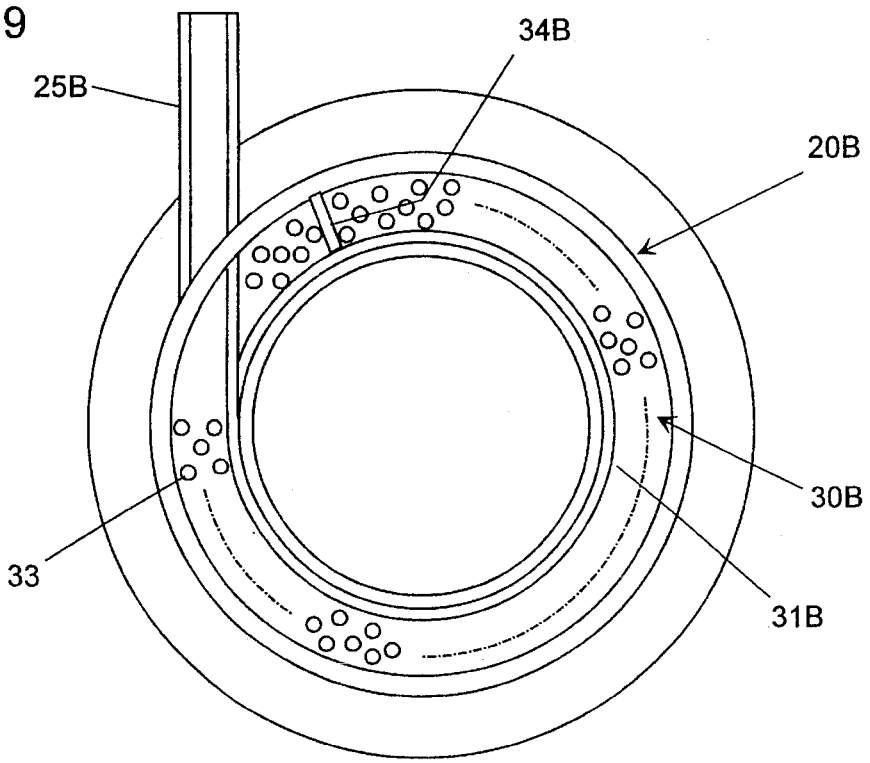
FIG. 9 is a plan view of the apparatus of FIG. 8.
Figure 10:
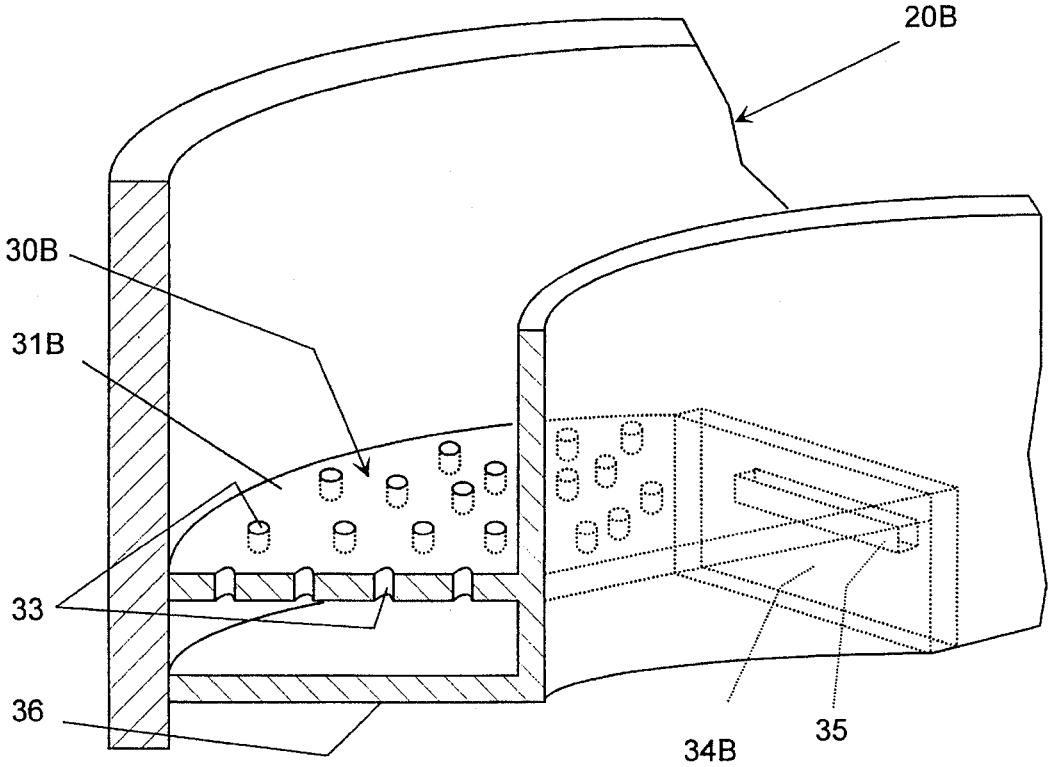
FIG. 10 is an enlarged perspective view of a portion of the apparatus of FIG. 8.

FIG. 5 illustrates a like parts washing and drying apparatus in accordance with a second embodiment of the present invention which is substantially identical to the first embodiment except for a specific structure for a drip zone $Z_2$. Like parts are designated by like numerals with a suffix letter of "A" for an easy reference purpose. The drip zone $Z_2$ has an elongated spiral track 30A which is divided along its length into a plurality of stepped sections by corresponding risers 34 extending from portions of the bed plate 31A. That is, as best shown in FIG. 7, the bed plate 31A of the spiral track 30A in the drip zone $Z_2$ is shaped to have stepped bottoms which are formed between the adjacent risers 34 and inclined upwardly towards the drying zone $Z_3$. The nozzle 26A is disposed at the upper end of the dripping zone $Z_2$ to spray the cleaning liquid over the parts on the upper stepped section of the spiral track 30A so that the liquid is directed downwards through the stepped sections in a direction opposite to the feeding direction of the parts along the spiral track 30A, thus increasing the chance of exposing the parts to the liquid for improved washing efficiency. As easily understood from FIG. 7, the liquid is fed along the stepped sections as repeatedly to overflow past the riser 34 from one stepped section to another, while forming a temporary pool P of the liquid in a lower portion of each stepped section and a drip section D in a higher portion of the same stepped section where the liquid is are dripped off the parts. Thus, the parts are fed upwardly along the spiral track 30A of the dripping zone $Z_2$ as repeatedly to be dipped in the pool of the liquid and dripped off the liquid for further enhancing washing efficiency.

Figure 11:
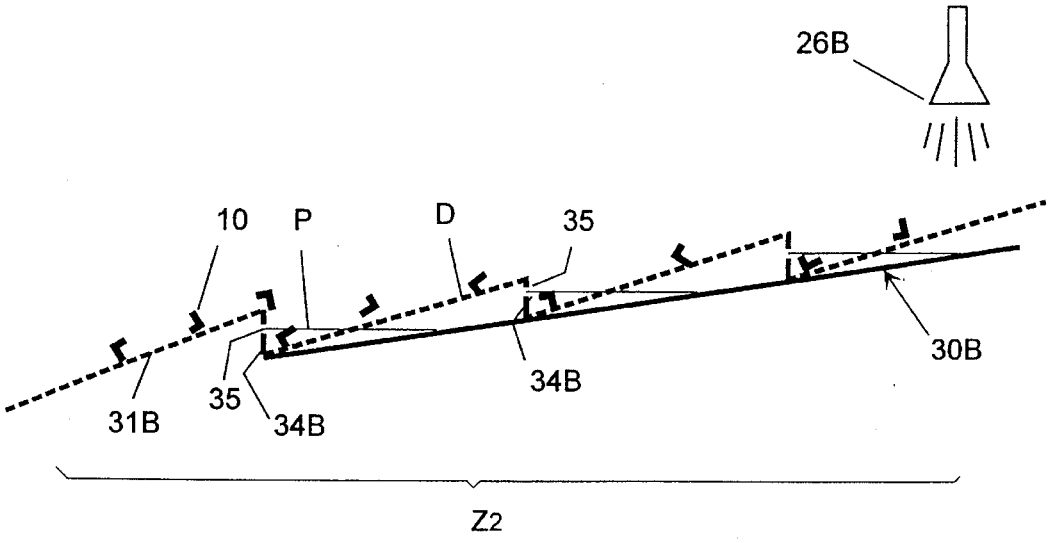
FIG. 11 is a schematic diagram illustrating a specific portion of a spiral track formed in the apparatus of FIG. 8.

FIGS. 8 to 11 illustrate a modification of the second embodiment which is basically identical to the second embodiment except that a gutter 36 is added to extend along the spiral track 30B of the dripping zone $Z_2$ in a juxtaposition therebelow and that the bed plate 31B in the dripping zone $Z_2$ is perforated to allow the liquid to communicate between the spiral track 30B and the gutter 36. Like parts are designated by like numerals with a suffix letter "B". In this modification, the liquid sprayed from the nozzle 26B is collected in the gutter 36 and is guided therealong while leaving temporary pools P on the stepped sections of the spiral track 30B in the dripping zone $Z_2$, as best shown in FIG. 11. The riser 34B is formed with a port 35 through which the liquid pass from the upper stepped section to the lower stepped section to leave a drip section D on the upper portion of each stepped bottom of the bed plate 31B. Thus, the parts 10 being fed upwardly through the spiral track 30B will travel repeatedly through the liquid pool P and the dripping sections D in a like manner as in the second embodiment for improving washing efficiency of the parts by the cleaning liquids, but in a more successive manner so as not to create an overflow of the liquid from one stepped section to another which might otherwise block smooth feeding of the parts along the spiral track 30B.

Third Embodiment <FIGS. 12 to 15>

Figure 12:
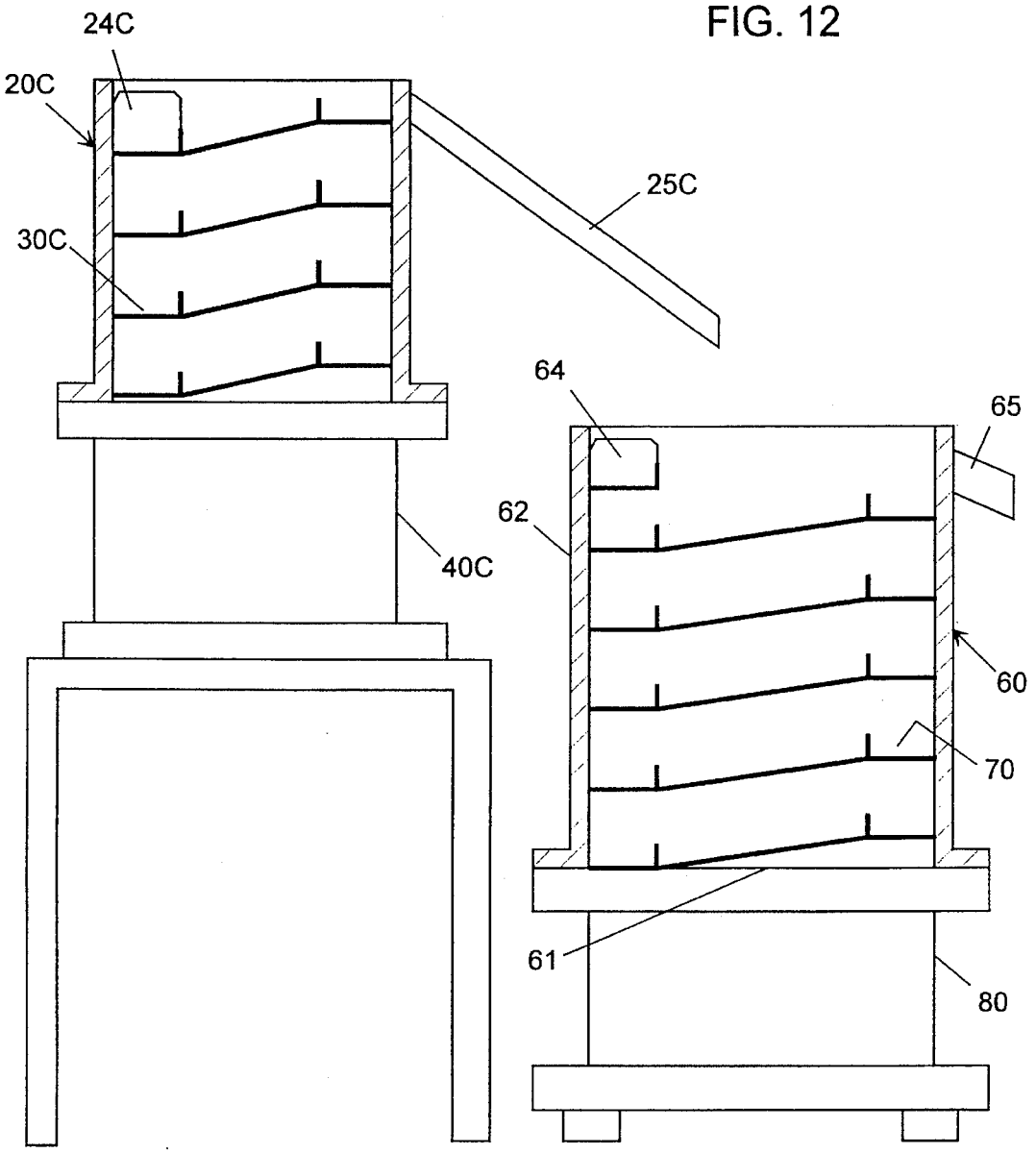
FIG. 12 is a schematic view illustrating a like apparatus in accordance with a third embodiment of the present invention.

Referring to FIG. 12, there is illustrated a parts washing and drying apparatus in accordance with a third embodiment of the present invention. The apparatus includes a separate drying vessel 60 in combination with the vessel 20C which is configured in accordance with any of the above embodiments and modification. The drying vessel 60 is disposed in a downward and sideward offset relation to the vessel 20C to receive the parts 10 that have been processed in the vessel 20C by way of a descending chute 25C from the upper end of the vessel 20C. The vessel 60 is of a top-opened cylindrical configuration with a bottom 61 and a side wall 62 and has its top opening disposed to receive the parts continuously from the chute 25C on to the bottom 61 of the vessel 60. A release port 64 is formed in the upper end of the side wall 22 discharge the parts 10 out of the vessel 60 by way of a discharge chute 65 extending outwardly from the release port 64. A spiral track 70 is formed to ascend along the interior surfaceof the side wall 62 about an upright axis of the vessel 60 from the bottom to the release port 64 for feeding the parts therealong by the like vibrations applied to the vessel 60 as described in the first embodiment. To this end, the vessel 60 is mounted on an additional vibrator 80, in the like manner as the vessel 20C is mounted on the vibrator 40C. Thus, the parts supplied from the vessel 20C experience an elongated travel path along the spiral track 70 from the bottom of the vessel 60 to the outlet 64 for successfully drying the parts.

Figure 13:
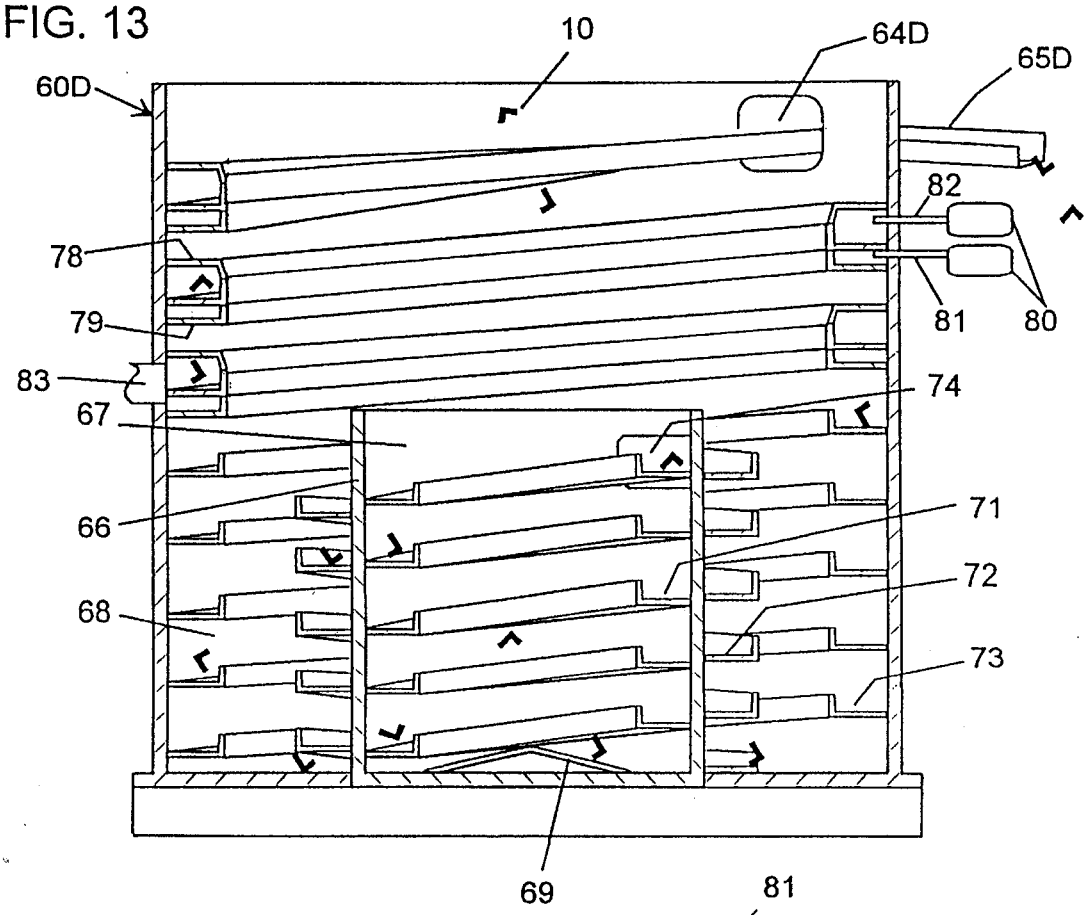
FIG. 13 is a vertical section of a drying vessel which may be utilized in the apparatus of FIG. 12.
Figure 14:
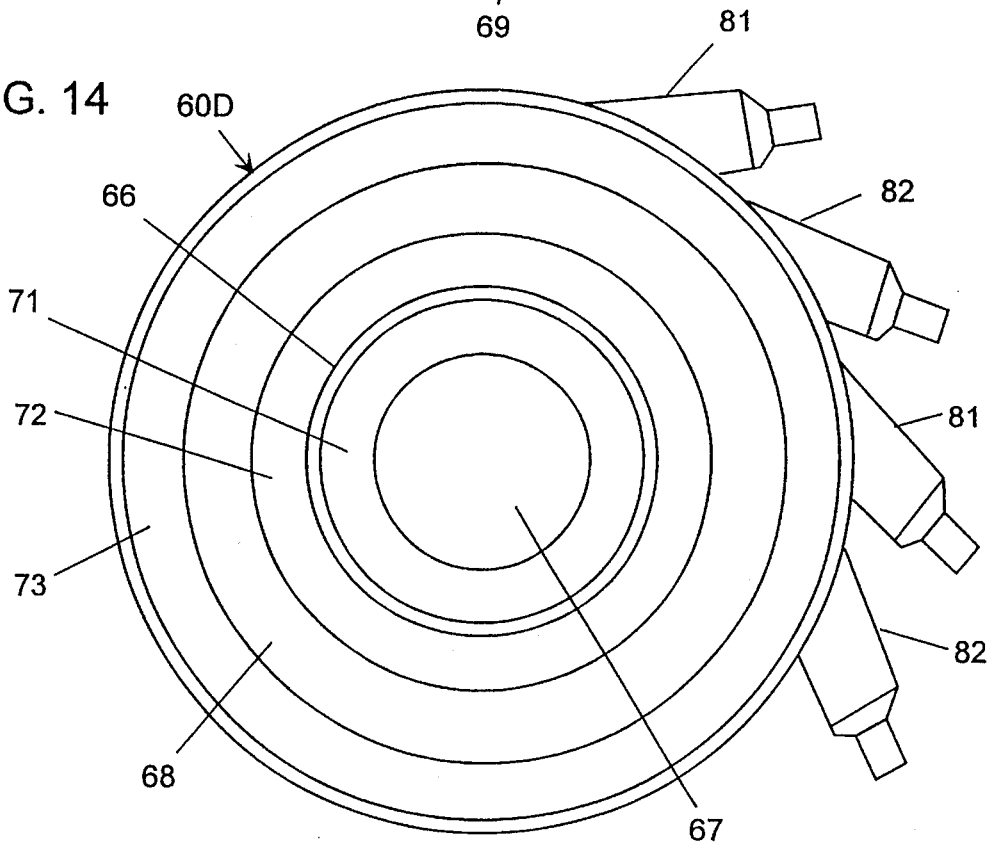
FIG. 14 is a plan view of the drying vessel of FIG. 13.

FIG. 13 illustrates a modified drying vessel 60D which may be utilized in the system of FIG. 12. The vessel 60D is of a double-wall structure with a partition 66 dividing the interior of the vessel 60D into an inner chamber 67 and an outer chamber 68 concentric to one another to have a common vertical center axis. The parts 10 are supplied through a top opening onto a conical shaped member 79 at the bottom of the inner chamber 67 and are guided thereby to the bottom periphery by the effect of the vibrations applied to the vessel 60D. The partition 66 is formed in its upper end with a transit port 74 through which the inner chamber 67 communicates with the outer chamber 68. The vessel 60D is formed at its upper end with a release port 64D through which the parts are discharged. The vessel 60D includes first and second spiral tracks 71 and 72 formed on the inner and outer surfaces of the partition 66 to extend in a spiral manner about the center vertical axis in the inner and outer chambers 67 and 68, respectively. The first spiral track 71 ascends from the bottom of the inner chamber 67 to the transit port 74 for feeding the parts upwardly therealong and outwardly through the transit port 74 by the effect of vibrations applied to the vessel 64D. The second spiral track 72 descends from the transit port 74 to the bottom of the outer chamber 68 in an oppositely spiraled manner to the first spiral track 71 to feed the parts downwardly therealong to the bottom of the outer chamber 68. Further, a third spiral track 73 is formed on the inner surface of the side wall of the vessel 60D to ascend within the outer chamber 68 from the bottom to the release port 64D in a spiral manner about the vertical center axis to feed the parts therealong to the release port 64D, Substantial portions of the first, second and third spiral tracks are perforated to facilitate dripping of any residual cleaning liquid off the parts 10. The upper region of the third spiral track 73 is provided with an upper cover 78 and a lower cover 79 to form individual ducts above and below the track 73, which ducts are connected respectively through tubes 81 and 82 to dryers or blowers 80 which introduce a forced hot air flow into the ducts for drying the parts 10 fed along the track 73. The tubes 81 and 82 are coupled respectively to the ducts at circumferentially spaced portions along the length of the track 73, as shown in FIG. 14, to direct the hot air flow in the direction opposite to the feeding direction of the parts. The track 73 is perforated to permit the hot air to pass therethrough between the ducts. The hot air is discharged through vents 83 outwardly of the vessel 60D.

Figure 15:
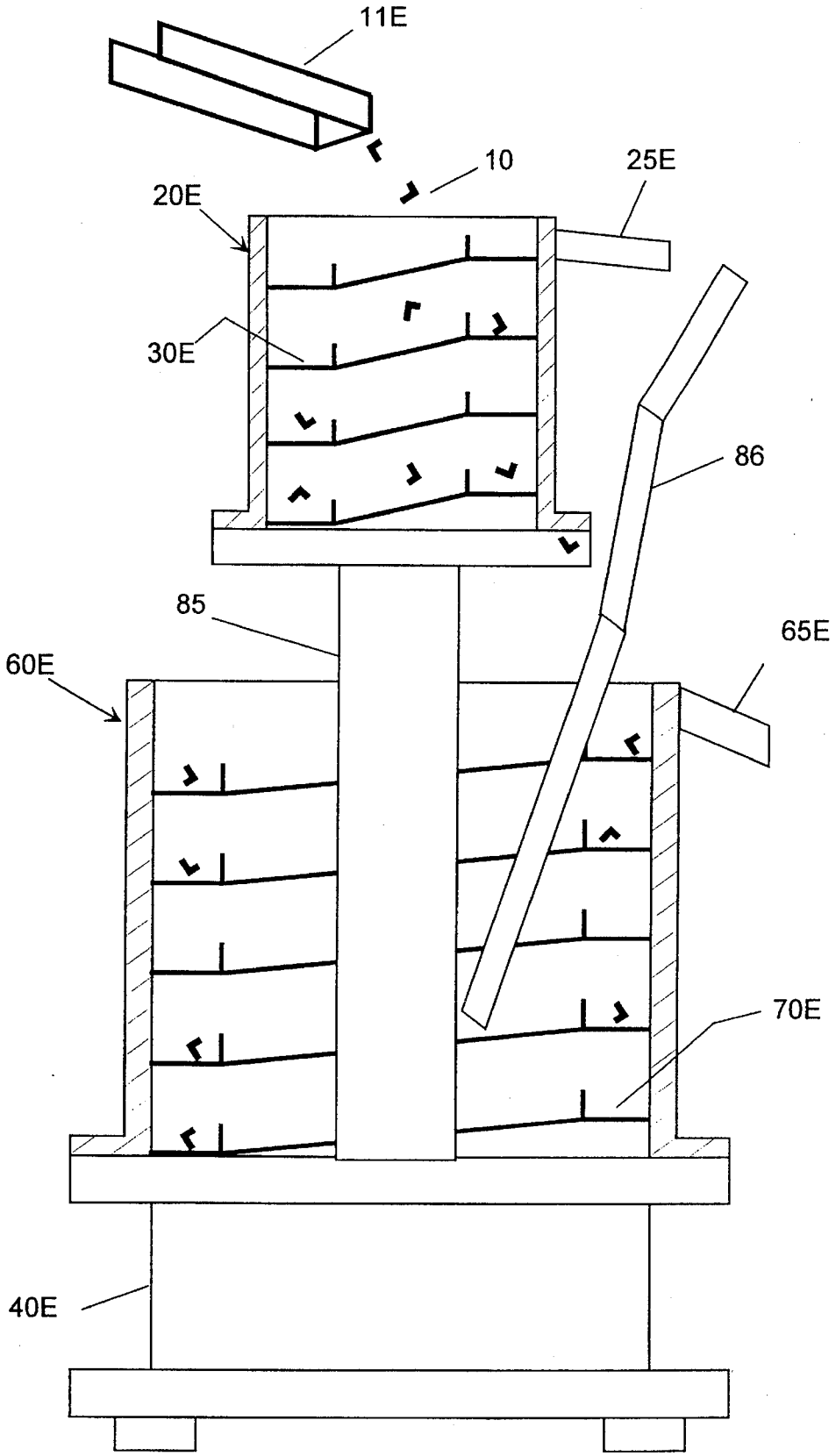
FIG. 15 is a schematic view illustrating a modification of the third embodiment.

FIG. 15 illustrates another modification of the third embodiment which is basically identical to the third embodiment except that a drying vessel 60E is concentrically disposed below the vessel 20E and that the vessels 20E and 60E are simultaneously vibrated by a single vibrator 40E. Like parts are designated by like numerals with a suffix letter of "E". The drying vessel 60E is mounted directly on the vibrator 40E and is mechanically connected to the vessel 20E through an upright rod 85 extending through the center of the drying vessel 60E so that the two vessels are vibrated simultaneously. A transfer chute 86 extends from below the discharge chute 25E of the vessel 20E towards the bottom of the drying vessel 60E for supplying the parts to the drying vessel 60E.

Figure 16:
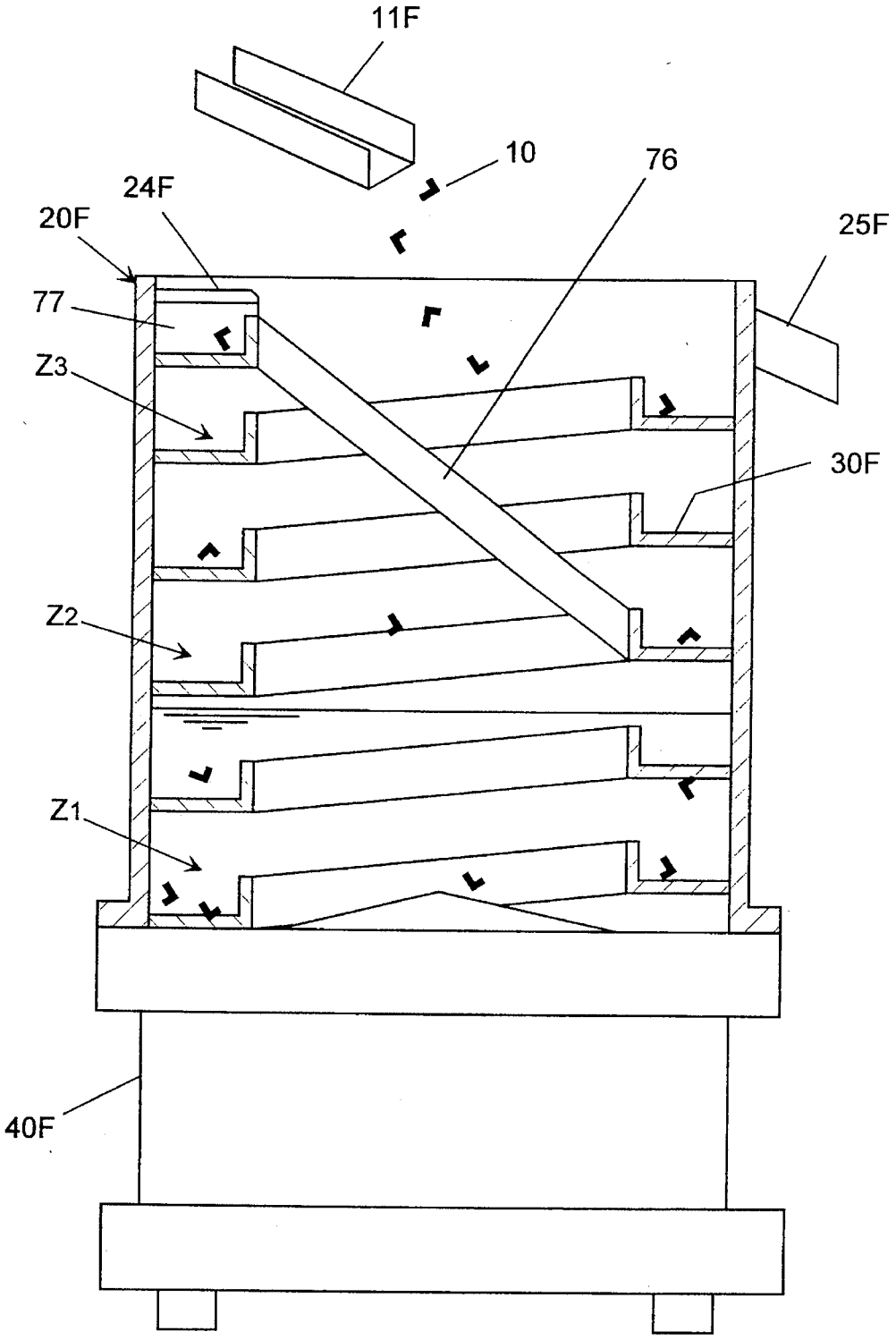
FIG. 16 is a vertical section of a like apparatus in accordance with a fourth embodiment of the present invention.
Figure 17:
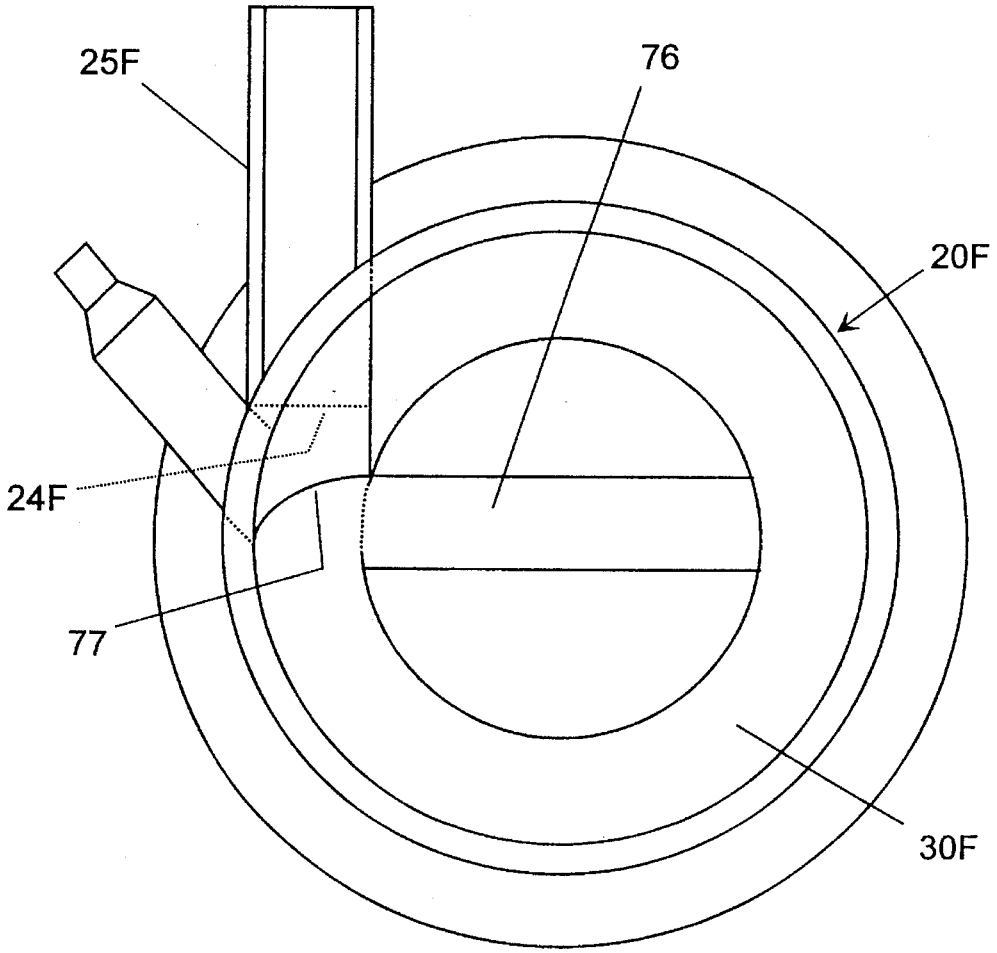
FIG. 17 is a plan view of the apparatus of FIG. 16.

Fourth Embodiment <FIGS. 16 and 17>

FIG. 16 illustrates, in a rather schematic diagram, a like parts, washing and drying apparatus in accordance with a fourth embodiment of the present invention which is basically identical to the first embodiment except that a return track 76 is included to extend from the spiral track 30F at the upper end of the drying zone $Z_3$ adjacent the outlet 24F down to the spiral track 30F at the lower end of the drying zone $Z_3$. Formed at the upper end of the return track 76 is a gate 77 which is controlled to open and close so as to selectively pass the parts 10 towards the discharge chute 25F and to the return track 76. Upon closure of the gate 77, the parts having been fed along the spiral track 30F of the drying zone $Z_3$ to reach the outlet 24F is fed back to the lower end of the drying zone $Z_3$ in order to once again dry the parts. In this manner, the parts can travel over an extended path until the parts are completely dried by controlling the gate 77, yet requiring no extra dimension to elongate the actual length of the spiral track 30F in the drying zone $Z_3$. Like parts are designated by like numerals with a suffix letter of "F". It should be noted here that the above scheme can be equally applied to the other embodiments and modifications discussed herein before and hereinafter.

Fifth Embodiment <FIGS. 18 to 21>

Figure 18:
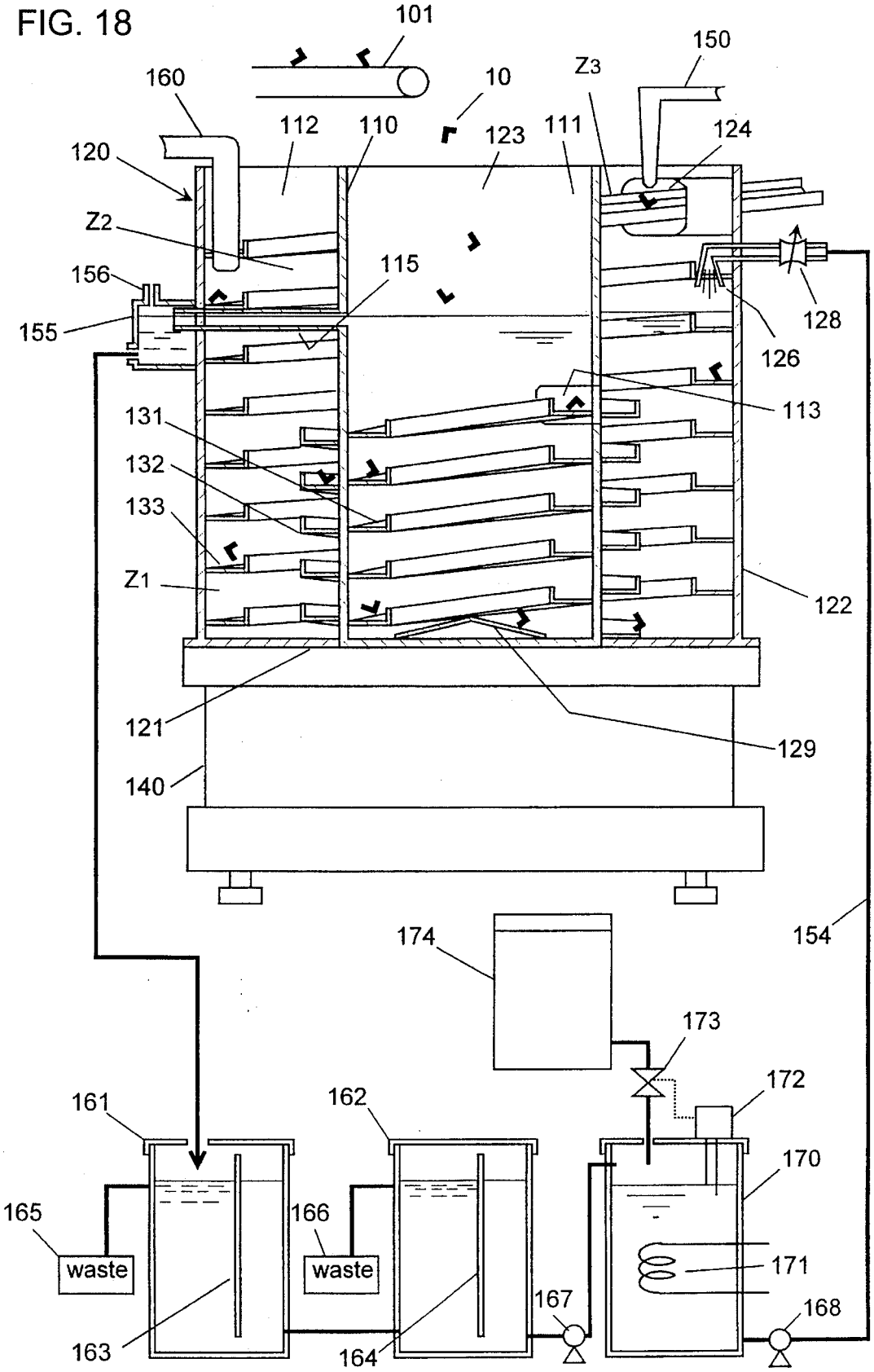
FIG. 18 is a vertical section of a like apparatus in accordance with a fifth embodiment of the present invention.

FIG. 18 illustrates a parts washing and drying apparatus in accordance with a fifth embodiment of the present invention. The apparatus includes a top-opened cylindrical vessel 120 with a bottom 121 and a side wall 122. The vessel 120 is of a double-wall structure with a partition 110 which divide the interior of the vessel into an inner chamber 111 and an outer chamber 112 which shares a vertical center axis. The inner chamber 111 defines at its top opening an inlet 123 through which discrete parts 10 being continuously supplied by way of a conveyer 101 are introduced on to the bottom of the inner chamber 111. The inner chamber 111 communicates with the outer chamber 112 through a transfer port 113 formed in the partition 110 intermediate its height, The outer chamber 112 is formed at its upper end with an outlet 124 for discharging the parts 10. A liquid supply line 154 is connected to supply a cleaning liquid into the outer chamber 112 through a nozzle 126 disposed within the outer chamber 112 at an elevation below the outlet 124 and above the transfer port 113. The cleaning liquid is allowed to pass through the transfer port 113 to fill the inner chamber 11. The inner chamber 111 is connected to an overflow conduit 115 which extends horizontally beyond the outer chamber 112 and terminates in a surge tank 155 on the exterior of the vessel 120, so that the liquid level in the inner chamber 111 as well as the outer chamber 112 is kept constant.

Formed in the inner chamber 111 is a first spiral track 131 which extends circumferentially along the inner surface of the partition 110 in a spiral manner about the vertical axis of the vessel 120 from the bottom to the transfer port 113 for feeding the parts upwardly therealong by the effect of vibrations applied to the vessel 120 from a vibrator 140 which is of the same configuration as utilize in the first embodiment and mounts the vessel 120 thereon. Thus, the parts 10 are washed by the cleaning liquid while being fed along the first spiral track 131, while leaving in the upper surface of the cleaning liquid in the inner chamber 111 a scum of contaminants separated from the surface of the parts 10. Subsequently, the parts 10 are fed along a second spiral track 132 formed on the exterior of the partition 110 to the bottom of the outer chamber 112. The second spiral track 132 descends in spiral manner about the vertical axis from the transfer port 113 to the bottom the outer chamber 112 in a direction opposite to the first spiral track 131 for feeding the parts downwardly therealong to the bottom of the outer chamber 112 by the same vibrations applied to the vessel 120. Also formed in the outer chamber 112 is a third spiral track 133 which ascends along the inner surface of the side wall of the vessel 120 in a spiral manner about the vertical axis from the bottom to and through the outlet 124 for feeding the parts 10 upwardly therealong and discharge the same out of the vessel 120 by the vibrations applied to the vessel 120. As shown in FIG. 18, the third spiral track 133 extends upwardly beyond the liquid level to define along the length thereof a washing zone $Z_1$, dripping zone $Z_2$ and drying zone $Z_3$ below and above the liquid level. The dripping zone $Z_2$ and drying zone $Z_3$ are defined respectively in the lower and upper regions of the third spiral track 133 extending above the liquid level. A steam shower 160 is provided in the outer chamber 112 above the lower end of the dripping zone $Z_2$, i.e., the portion of the third spiral track 133 immediately above the liquid level to give a steam jet over the parts 10 just emerging out of the liquid for washing off the liquid remaining on the parts 10. Thereafter, the water is dripped off the parts 10 while they are being fed along the spiral track 133 in the dripping zone $Z_2$ towards the drying zone $Z_3$. A dryer 160 is disposed at the upper end of the drying zone $Z_3$ adjacent the outlet 124 to give a forced hot air flow over the parts 10 for drying the same. The third spiral track 133 in the dripping and drying zones $Z_2$ and $Z_3$ is perforated to entrance the dripping and drying of the parts.

The liquid overflowing from the inner chamber 111 is once stored in the surge tank 155 and then fed through primary and secondary separation tanks 161 and 162 with respective baffle plates 163 and 164 for separation of the contaminants from the liquid, while the resulting wastes are recovered into associated waste tanks 165 and 166. Subsequently, the liquid is fed by a pump 167 to a control tank 170 where it is heated by a heater 170 to a suitable temperature for effective cleaning and is directed by a pump 168 through the nozzle 126 to be supplied into the outer chamber 112. The control tank 170 has a level sensor 172 which activates a valve 173 to to supply an additional amount of a fresh cleaning liquid from a replenish tank 174 for keeping the liquid level in the control tank 170 constant. In this manner, the liquid is recirculated through the liquid supply line 154 including the vessel 120 and the tanks. The amount of the cleaning liquid sprayed from the nozzle 126 is controlled by a valve 128 so as to keep the liquid level in the outer chamber 112 slightly higher than that in the inner chamber 111. It is noted in this connection that since the transfer port 113 is disposed below the overflow conduit 115, i.e, below the liquid level of the vessel 120, there is no chance of the liquid flowing through the transfer port 113 in a reverse direction from within the inner chamber to the outer chamber, thereby keeping the liquid in the outer chamber cleaner than within the inner chamber for assuring successful and continuous cleaning of the parts by the liquid. A conical shaped member 129 is provided on the bottom of the inner chamber 111 for guiding the parts to the lower end of the first spiral track 131.

Figure 19:
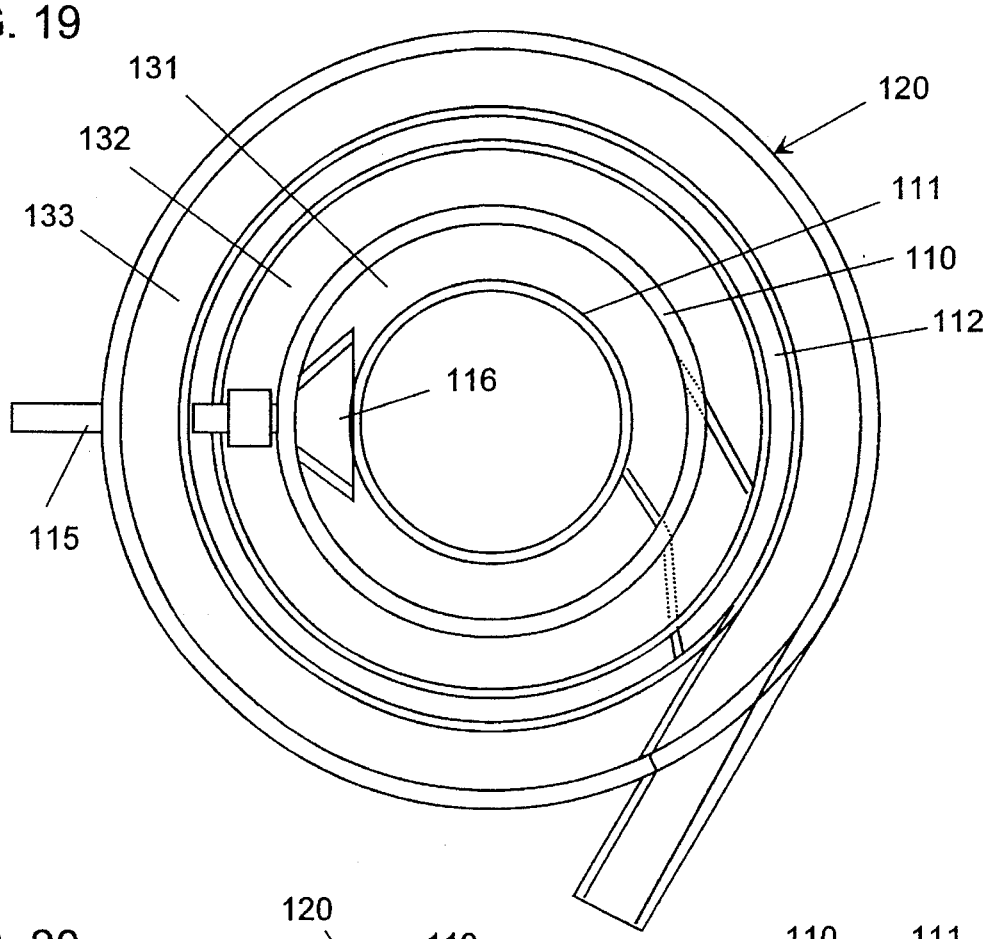
FIG. 19 is a plan view of the apparatus of FIG. 18.
Figure 20:
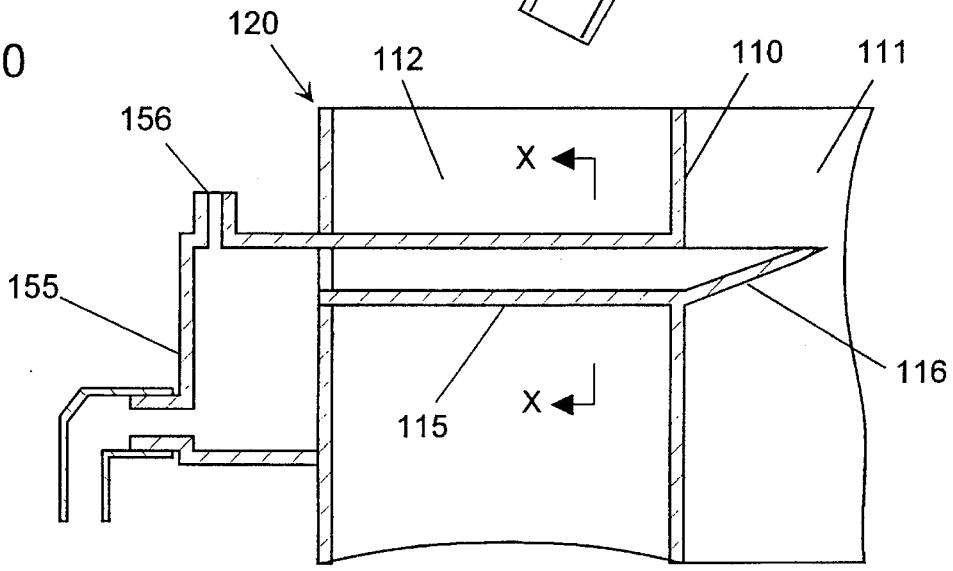
FIG. 20 is an enlarged vertical section of a portion of the apparatus of FIG. 18.
Figure 21:
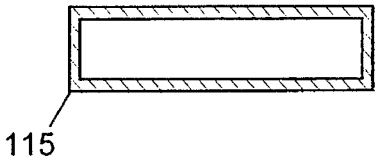
FIG. 21 is a section taken along line X—X of FIG. 20.

As shown in FIGS. 19 and 20, the overflow conduit 115 is formed at its end with a scoop 116 for effectively gathering the scum of the contaminants and has a wide cross section, as shown in FIG. 21, to direct the scum into the surge tank 155. The surge tank 155 is provided with a bleed vent 168 to facilitate the draw-in of the liquid with the scum from the inner chamber 111 into the surge tank 155.

Figure 22:
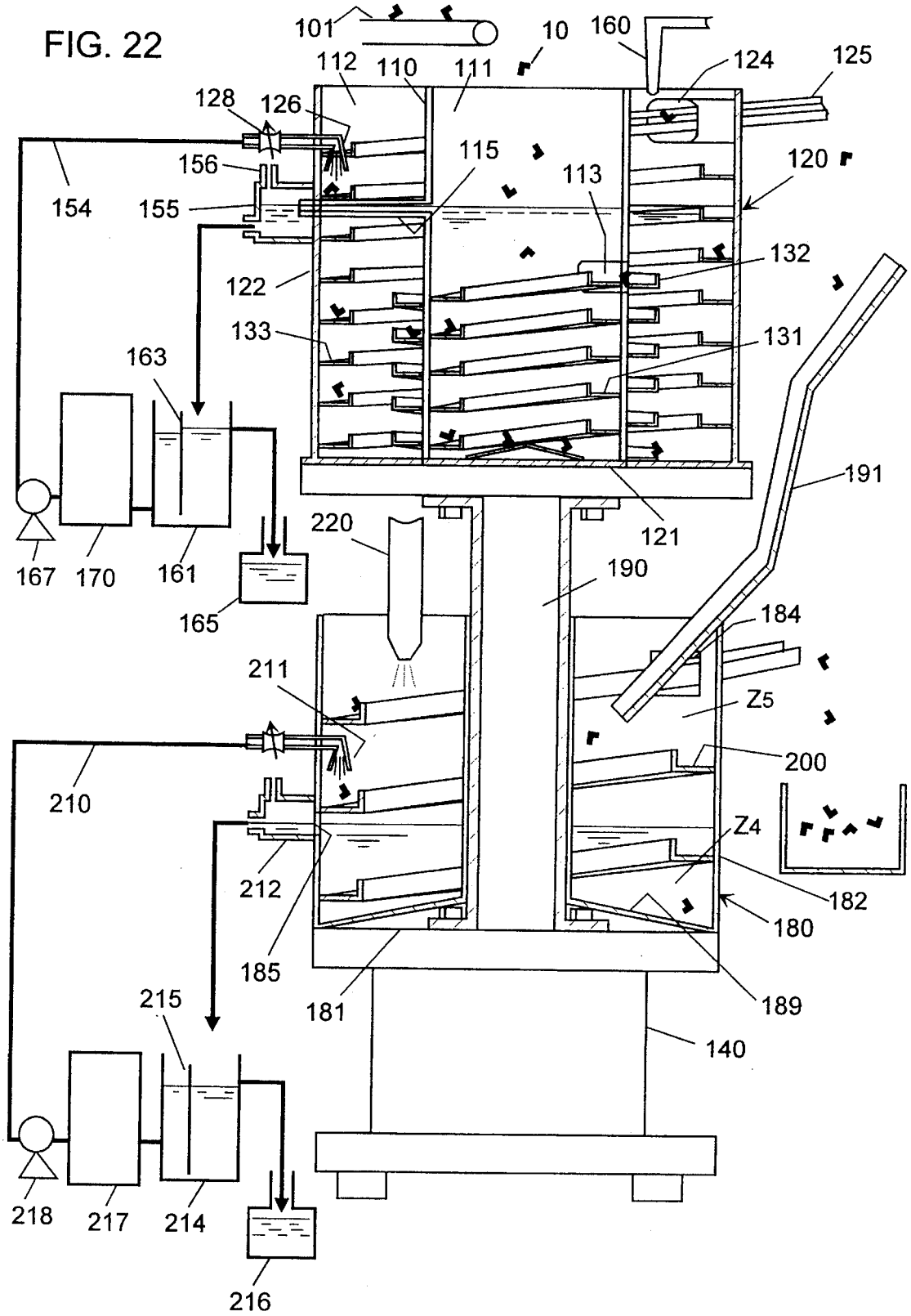
FIG. 22 is a vertical section of a like apparatus in accordance with a sixth embodiment of the present invention.

Sixth Embodiment <FIG. 22>

FIG. 22 illustrates a parts washing and drying apparatus in accordance with a sixth embodiment of the present invention which includes a water tank 180 in addition to the vessel 120 which is basically identical to that utilized in the fifth embodiment of FIG. 18, but excludes the dryer 150. The water tank 180 is of a top-opened cylindrical configuration with a bottom 181 and a side wall 182 and disposed below the vessel 120 in a concentric relation thereto. The water tank 180 is mounted directly upon the vibrator 140 and is mechanically connected to the vessel 120 by means of an upright rod 190 so that the vessel 120 and the water tank 180 are simultaneously vibrated by the common vibrator 140. A transfer chute 191 extends from below the discharge chute 125 of the vessel 120 into the water tank 180 to supply the parts 10 onto the bottom of the water tank 180. Formed on the bottom of the water tank 180 is a conical shaped member 189 to guide the parts toward the inner circumference of the bottom 181. A spiral track 200 is also formed in the water tank 180 to extend along the inner surface of the side wall 182 in a spiral manner about the vertical axis from the bottom 181 to and through an outlet 184 formed in the upper end of the tank 180 in order to feed the parts 10 upwardly therealong from the bottom and discharge them out of the tank 180. A water supply line 210 is connected to the tank 180 to spray a water through a water shower 211 disposed intermediate the height of the tank to fill the tank with water, while exposing the parts being fed along the spiral track 200 to a water shower. An overflow port 185 is formed in the side wall 182 below the water shower 211 to overflow an excess amount of water from the water tank to keep the water level constant. The spiral track 200 extends beyond the water level so as to define a water washing zone $Z_4$ and a drying zone $Z_5$ below and above the water level. Thus, the parts are washed with water while being fed along the spiral track 200 in the water washing zone $Z_4$ and are subsequently dripped off the water followed by being dried while being fed along the remaining spiral track 200 in the drying zone $Z_5$. The contaminants still remaining on the parts are separated by the water washing and aggregate into a scum which is recovered through the overflow port 186 together with the water into a surge tank 212 on the exterior of the tank 180 and is subsequently fed into a separation tank 214 with a baffle plate 215. The contaminants are finally separated by the baffle plate 215 and are recovered into a waste tank 216. The liquid removed of the contaminants are fed to a control tank 217 where it is replenished with a fresh water as necessary and is then fed back by a pump 218 into the water tank 180 through the water shower 211. A dryer 220 is disposed in the drying zone $Z_5$ above the water shower 211 to direct a forced hot air flow over the parts 10 being fed along the spiral track 200 towards the outlet 184 for facilitating the drying. The spiral track 200 is preferably perforated to expedite the dripping and drying of the parts.

It should be noted that the drying zone of the fifth and sixth embodiment may be configured into like structure as disclosed in the first embodiment. Also, the dripping zone of the fifth and sixth embodiments may be configured in accordance with the second embodiment and the modification thereof. Further, all the structures disclosed in the above embodiments can be suitably combined for the purpose of washing and drying the parts on a continuously feeding basis.

What is claimed is:

1. An apparatus for washing and drying discrete parts which comprises:

a vessel with a vertical axis, a closed bottom and a side wall extending upwardly from the circumference of said bottom, said vessel being divided by a partition into an inner chamber and an outer chamber which are coaxial with said vertical axis, said inner chamber having an inlet for introducing the discrete parts on a bottom of said inner chamber, a transfer port for delivering said parts from said inner chamber to said outer chamber, said outer chamber having an outlet for removing the part out of said vessel;

a liquid supply line connected to supply a cleaning liquid to said outer chamber, said cleaning liquid being delivered to said inner chamber through said transfer port so that said inner chamber and said outer chamber are filled with the cleaning liquid the level of which is above said transfer port;

an overflow line connected to said inner chamber at a portion above said transfer port so as to overflow the cleaning liquid from said inner chamber for keeping the cleaning liquid at a level above said transfer port;

a first spiral track formed on the interior surface of said partition and ascending therealong in a spiral manner about said vertical axis from said bottom of said inner chamber and reaching said transfer port;

a second spiral track formed on the exterior surface of said partition and descending therealong in a spiral manner about said vertical axis from said transfer port to the bottom of said outer chamber;

a third spiral track formed on the interior surface of said side wall and ascending therealong in a spiral manner about said vertical axis from a bottom of said outer chamber and reaching said outlet which is disposed above the level of the cleaning liquid in said outer chamber;

a vibrator operatively connected to said vessel for applying thereto vertical and circumferential vibrations which gives a driving force of feeding said discrete parts upwardly along said first spiral track, downwardly along said second spiral track, and upwardly along said third spiral track said parts being fed along said first and second spiral track in the volume of said cleaning liquid respectively contained in said inner and outer chambers to be thereby washed;

said third spiral track extending above the level of the cleaning liquid in said outer chamber to define along the length thereof a cleaning zone and a drying zone respectively below and above the level of the cleaning liquid such that the parts being fed along said cleaning zone are washed by the cleaning liquid in said outer chamber and that the parts being fed along said drying zone am removed of the cleaning liquid.

2. An apparatus as set forth in claim 1, wherein said outer chamber is provided with a steam nozzle and an air nozzle, said steam nozzle disposed above the connection of said overflow line to said inner chamber to discharge a steam over the pars being fed along a lower portion of said drying zone, said air nozzle disposed above said steam nozzle to give a forced air flow over the parts fed along an upper portion of said drying zone to said outlet.

3. An apparatus as set forth in claim 1, further including:

a water tank disposed below and coaxial with said vessel to share said vertical axis, said water tank having a closed bottom and a peripheral wall extending upwardly from the circumference of said bottom, said tank provided with a transfer inlet for delivering said parts into the bottom of said tank and an release port for removing said parts out of said tank:

a chute extending downwardly from said outlet of said vessel to said transfer inlet for transferring said parts by gravity into said tank;

a water supply line connected to supply a water into the tank;

a water overflow line connected to said tank at a portion below said a release port so as to overflow the water from said water tank for keeping the water in the tank at a constant level below said release port;

a fourth spiral track formed on the interior surface of said peripheral wall of said water tank and ascending therealong in a spiral manner about said vertical axis from the bottom of said tank and reaching said release port:

a rod connecting said tank and said vessel commonly to said vibrator so as to give a driving vibration force of feeding said discrete parts upwardly along said fourth spiral track from the bottom of said water tank to said release port;

an air nozzle dispensed adjacent to said fourth track at a portion above the connection of said water overflow line to said tank for giving a forced air flow over the parts on said fourth spiral track;

said fourth spiral track extending beyond the level of the water in said water tank to define along the length thereof a water washing zone and a drying zone respectively below and above the level of the water such that the parts being fed along said water washing zone are washed by the water in said tank and that the parts being fed along said drying zone are removed of the water by exposure to said forced air flow from said air nozzle.

4. An apparatus as set forth in claim 1, wherein said cleaning liquid is an aqueous solution of a substance capable of separating a grease from the surface of the parts without substantially emulsifying the separated grease.

5. An apparatus as set forth in claim 4, wherein said substance is N-methyl-2-pryrrolidone.

* * * * *